US005806851A

United States Patent [19]

Gomez et al.

[11] Patent Number: 5,806,851

[45] Date of Patent: Sep. 15, 1998

[54] INTERACTIVE PLAY FOR A PINBALL GAME

[75] Inventors: George Gomez, Evanston; Thomas M. Kopera, Villa Park, both of Ill.; Thomas W. Uban, Valdaraiso, Ind.

[73] Assignee: Williams Electronics Games, Inc., Chicago, Ill.

[21] Appl. No.: 815,060

[22] Filed: Mar. 11, 1997

[51] Int. Cl.[6] ..... A63F 7/02

[52] U.S. Cl. ..... 273/121 A; 273/118 A; 273/119 A; 273/127 R; 273/129 S

[58] Field of Search ..... 273/118, 119, 273/121, 129 R, 129 S, 127 R, 127 B

[56] References Cited

U.S. PATENT DOCUMENTS

| | | | |
|---|---|---|---|
| 4,148,486 | 4/1979 | Tepper | 273/129 S X |
| 4,973,056 | 11/1990 | Nutting | 273/129 S X |
| 5,181,722 | 1/1993 | Krutsch et al. | 273/121 A X |
| 5,186,462 | 2/1993 | Biagi et al. | 273/129 S |
| 5,255,916 | 10/1993 | Bleich . | |
| 5,524,887 | 6/1996 | Trudeu et al. . | |
| 5,533,726 | 7/1996 | Nordman et al. | 273/121 A X |

OTHER PUBLICATIONS

"World Cup Soccer" product brochure (©1994).

*Primary Examiner*—Raleigh W. Chiu
*Attorney, Agent, or Firm*—Rudnick & Wolfe

[57] ABSTRACT

An interactive play feature for a pinball game includes a shooting position on an inclined playfield and a target spaced apart from the shooting position. A shooting mechanism is responsive to input from a player for propelling a game ball from the shooting position toward the target. The game ball normally follows a path of travel from the shooting position to the target when propelled by the shooting mechanism. A blocking member is movable to a blocking position in response to the game ball reaching a desired position, wherein the blocking member obstructs the path of travel of the game ball to prevent the game ball from reaching the target.

27 Claims, 3 Drawing Sheets

INTERACTIVE PLAY FOR A PINBALL GAME

BACKGROUND OF THE INVENTION

The present invention relates generally to pinball games, and more particularly, to an interactive play feature including pass, shoot and defend aspects for simulating the game of basketball or the like.

Pinball games typically include an inclined playfield housed within a game cabinet and having mounted thereon a number of playfield features such as bumpers, ramps, movable targets, outholes and the like. The playfield features influence the motion of the game ball, which is projected towards the features by flippers that are controlled by the game player. Pinball games appeal to players because of the novel arrangement of game features that make the game challenging and exciting to play. Generally, increased interaction between the player and the game means increased appeal. As players become more skilled at a particular game, however, the game loses its challenge and appeal. In order to maintain player interest and to satisfy the needs of the pinball game markets, novel game features and arrangements are constantly required.

Conventional pinball games have playfield features that respond to contact by the pinball. These playfield features lack the ability to communicate with the game player by reacting to a particular decision or action of the player. Such an ability makes it more difficult and challenging for the player to either "outwit"the game or play faster than a computer can react. A playfield feature having the capability to interact with the game player is therefore desirable. It is also desirable to incorporate such an interactive play feature into a popular game to make it more interesting for a player. A particularly entertaining game to watch and emulate is professional basketball which has gained in popularity over the years. Playing the game of basketball requires several basic skills such as passing and shooting to overcome the efforts of a defender to block a shot. A time limit for taking a shot isferred to as the "shot clock" or the "24-second clock." Thus, it is desirable to provide an interactive play feature for a pinball game that emulates a popular game such as professional basketball.

Some pinball games are equipped with elevated play features, including, for example, rotary storage receptacles, elevated ramps and/or smaller playfields elevated above the main playfield. Access is sometimes provided by configuring these elevated features with inclined ramps to lift the ball from the main playfield to the storage receptacle or elevated ramp. Often, a player must activate a combination of features to allow the game ball access to the elevated feature. It is therefore desirable to provide a means of "shooting" a game ball onto an elevated play feature such as a receptacle to simulate shooting a basketball into a basket.

Another common play feature is a ball popper, which typically includes a recess or eject hole for trapping the game ball on or below the playfield for a period of time until an ejection device pushes the ball back onto the playfield. Ejection of the ball from the recess is usually accomplished by a solenoid activated plunger mechanism. Actuation of the plunger mechanism is typically controlled by a microprocessor rather than in response to input from a player.

It is therefore desirable to provide an interactive play feature for a pinball game that emulates a popular game such as professional basketball wherein the player has control over passing and shooting in order to make a basket before the shot can be blocked by a defender which is controlled by a microprocessor.

SUMMARY OF THE INVENTION

In view of the above, and in accordance with the present invention, an interactive play feature for a pinball game includes a shooting position on an inclined playfield and a target spaced apart from the shooting position. A shooting mechanism is responsive to input from a player for propelling a game ball from the shooting position toward the target. The game ball normally follows a path of travel from the shooting position to the target when propelled by the shooting mechanism. A computer-controlled blocking member is movable to a blocking position in response to the game ball reaching a desired position, wherein the blocking member obstructs the path of travel of the game ball to prevent the game ball from reaching the target.

In a preferred embodiment of the invention, a plurality of shooting positions are provided in the form of four ejection holes formed in the playfield. The ejection holes preferably lie along an arc and retain the game ball in fixed shooting positions. A receptacle configured as a basket with an open top is positioned above the playfield and is horizontally spaced from the ejection holes toward the concave side of the arc. Each of the ejection holes has a curved wire guide rail extending upwardly therefrom and curving toward the receptacle to define respective shooting paths of travel and guide the game ball from the various shooting positions to the receptacle. Each ejection hole has a shooting mechanism associated therewith, preferably in the form of a ball popper. The "shooting" ball poppers are positioned below the playfield for propelling the game ball out of the associated ejection hole and generally upwardly toward the receptacle. The shooting ball poppers are responsive to input from a player so that the player can shoot the game ball from a desired location at a desired time.

Each of the ejection holes is also provided with one or more "passing" ball poppers mounted below the playfield and angled to allow passing of the game ball to adjacent ejection holes. Preferably, the two middle ejection holes are each provided with two passing ball poppers so that the game ball can be passed to the adjacent ejection holes on either side thereof, whereas the ejection holes on the ends only need one passing ball popper because there is only one adjacent ejection hole. As with the shooting ball poppers, the passing ball poppers are responsive to input from a player for propelling the game ball between the respective shooting positions. Thus, the player has complete control over when to shoot and from which shooting position.

Also preferably, the blocking member is adapted to move between four blocking positions corresponding to the four shooting positions or ejection holes. When the blocking member is in front of a particular shooting position, a generally horizontally extending portion obstructs the shooting path of travel to prevent the game ball from reaching the receptacle. A moving mechanism is also provided for moving the blocking member between the various blocking positions. The moving mechanism includes a motor having a pivot arm. The blocking member extends upwardly from an end of the pivot arm and through a curved slot formed in the playfield which has the same general curvature as the arc of alignment of the ejection holes. Preferably, a sensor is adapted to detect when the game ball is approaching one of the shooting positions, whereupon the blocking member is actuated to move into the corresponding blocking position. It is therefore an objective of the player to pass the ball to a desired shooting location and shoot the ball before the defender arrives to block the shot.

If the shot is blocked, or if a "24-second clock" expires before a shot is taken, a system is provided for removing the ball from the interactive playfield. Preferably, a magnet is mounted on the playfield and positioned generally in the passing path of travel between the two middle shooting positions. The magnet is adapted to be energized in response to a blocked shot or in response to the expiration of the 24-second clock to thereby intercept the game ball in the passing lane between the two middle shooting positions. Once the magnet catches the game ball, the magnet is de-energized to allow the game ball to roll out of the interactive field of play. If the game ball is blocked from one of the middle shooting positions, the player loses control of all the ball poppers and the associated passing ball popper automatically passes the game ball to the other middle shooting position so that the magnet can intercept the pass. If the game ball is blocked from one of the end shooting positions, the associated passing ball popper passes the game ball to the adjacent middle shooting position, whereupon the associated passing ball popper passes the ball to the other middle shooting position for interception by the magnet.

The present invention provides significant advantages over other play features of pinball games. The interactive nature of the defender makes it challenging for a player to pass and shoot the ball before the defender can block a shot, which keeps the game moving at a fast pace and maintains the interest of a player.

The present invention, together with further objects and advantages, will be best understood by reference to the following detailed description taken in conjunction with the accompanying drawings.

DETAILED DESCRIPTION OF THE PREFERRED EMBODIMENT

Figure 1:
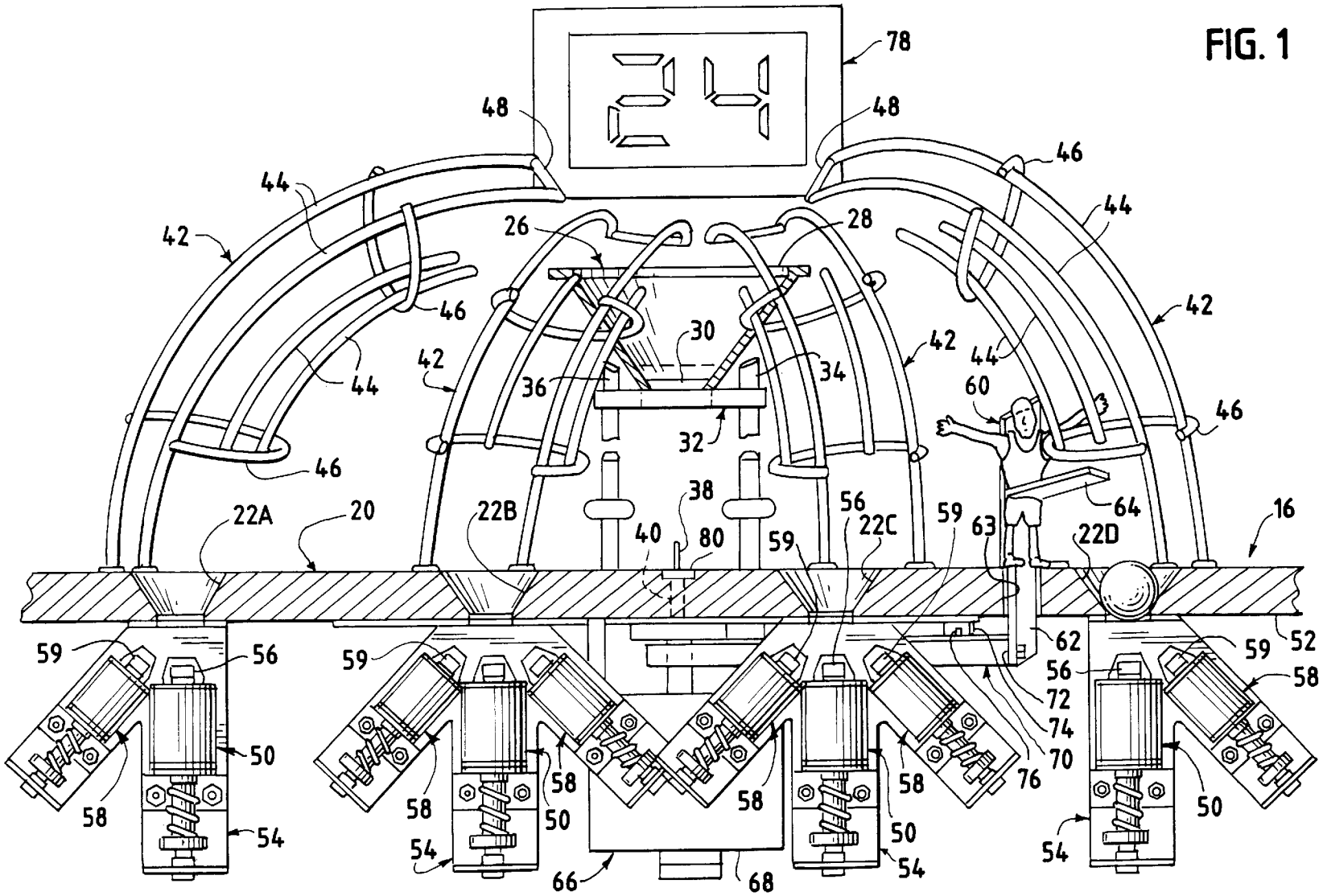
FIG. 1 is a partial section view of the interactive play feature of the present invention showing a defender in a blocking position in front of an ejection hole in which a game ball is located for either passing or shooting.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated. Referring to the drawings, a typical pinball machine 10 includes a pinball cabinet 12 having a back box 14 for displaying the game score. The cabinet 12 houses an inclined playfield 16 which includes thereon a number of playfield features such as flipper elements, ramps, bumpers, target elements and the like (not shown). Game play is initiated by activating a plunger element to shoot the game ball up an alley 18 onto the playfield 16. A microprocessor is used to control play of the game and operation of the interactive play feature of the present invention described herein.

Figure 2:
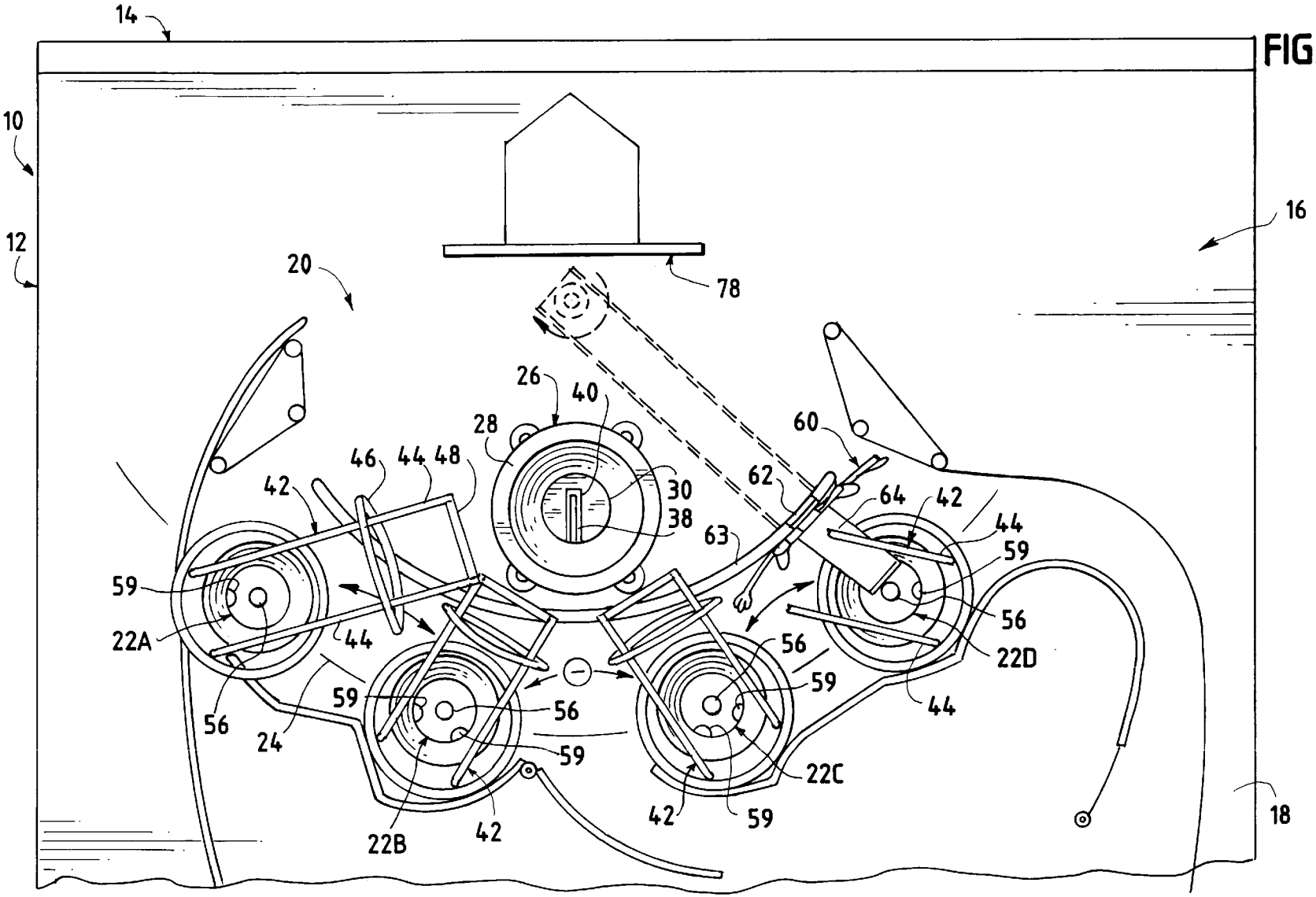
FIG. 2 is a top view of the interactive play feature shown in FIG. 1. perspective view of a pinball machine incorporating a preferred embodiment of the present invention.

Referring to the drawings, there is shown in FIGS. 1 and 2 an interactive playfield area 20 referred to as "in the paint" which is part of the main playfield 16. As will be discussed in more detail below, the game ball can be directed to various locations in the playfield area 20 by other playfield features such as ramps or the like (not shown). The game ball can also merely roll into the playfield area 20 from the top of the inclined playfield 16. Once on the playfield area 20, the player can play the interactive pass, shoot and defend aspects of the present invention.

As illustrated in FIGS. 1 and 2, the game feature includes four ejection holes 22A–22D formed in the playfield 16 for temporarily retaining the game ball in a plurality of fixed shooting positions. Preferably, the ejection holes 22A–22D lie along an arc 24 so they are equidistant from a target as shown in FIG. 2. Scoring is achieved by shooting the game ball from one of the ejection holes 22A–22D through an inverted frusto-conically shaped basket 26 with an open top 28 and an open bottom 30. The basket 26 is mounted on a bracket 32 above the playfield 16 and is horizontally spaced from the ejection holes 22A–22D toward the concave side of the arc 24. To detect when the player makes a basket, an optical sensor consisting of a transmitter 34 and a receiver 36 are provided toward the bottom 30 of the basket 26. The transmitter 34 and receiver 36 are positioned on opposite sides of the basket 26 so that when the game ball passes through the basket 26, the optical path between the transmitter 34 and receiver 36 is interrupted, thereby detecting that a basket has been made and sending a signal to the microprocessor that points are to be awarded to the player. Preferably, a backup scoring detection device is also provided in the form of a microswitch 38 positioned directly underneath the basket 26 and extending upwardly through a slot 40 in the playfield 16. Thus, if the optical sensor malfunctions or otherwise fails to detect the game ball as it passes through the basket 26, the game ball will fall on the microswitch, which retracts into the playfield 16 and sends a signal to the microprocessor that the player has scored.

To define respective shooting paths of travel and guide the game ball from the various shooting positions to the basket 26, a plurality of curved guide rails 42 (ball guides) are mounted to the playfield 16 around the periphery of the associated ejection holes 22A–22D. Each guide rail 42 extends generally upwardly from the associated ejection hole 22A–22D and curves toward the basket 26 so that the game ball is deposited in the basket 26 when propelled through the guide rails. Preferably, the guide rails 42 are each formed of four curved wires 44 with connecting rings 46 and a terminal cross-bar 48 as shown in FIG. 1.

To propel the game ball through the ejection holes 22A–22D, into the guide rails 42 and toward the basket 26, each ejection hole 22A–22D has a shooting mechanism associated therewith, preferably in the form of a solenoid activated ball popper 50. The "shooting" ball poppers 50 are mounted in generally vertical positions to an underside 52 of the playfield 16 by brackets 54. The ball poppers 50 are well-known in the art and its operation and construction will be readily apparent to those of ordinary skill. Generally, the game ball is positioned so that when the associated ball poppers 50 are actuated, plungers 56 win extend upwardly to propel the ball through one of the ejection holes 22A–22D. The shooting ball poppers 50 are responsive to input from a player so that the player can shoot the game ball from a desired location at a desired time.

Each of the ejection holes 22A–22D is also provided with one or more "passing" ball poppers 58 mounted to the brackets 54 below the playfield 16 and angled to allow passing of the game ball to adjacent ejection holes. As shown in FIG. 1, the two middle ejection holes 22B and 22C are each provided with two passing ball poppers 58 angled in opposite directions so that the game ball can be passed to the adjacent ejection holes on either side thereof. Thus, the passing ball poppers 58 associated with ejection hole 22B are positioned to pass the game ball to either the ejection hole 22A on the left or the ejection hole 22C on the right. Similarly, the passing ball poppers 58 associated with ejection hole 22C are positioned to pass the game ball to either the ejection hole 22B on the left or the ejection hole 22D on the right. In contrast, the two end ejection holes 22A and 22D are only provided with one passing ball popper 58 because there is only one adjacent ejection hole. As with the shooting ball poppers 50, the passing ball poppers 58 have plungers 59 and are responsive to input from a player for propelling the game ball between the respective shooting positions or ejection holes 22A–22B. Specifically, the player can pass to the left or the right by pressing corresponding left or right flipper button on the pinball machine to actuate the associated passing ball popper 50. Thus, the player has complete control over when to shoot and from which shooting position.

To challenge the player, a blocking member or defender 60 is provided to move between four blocking positions corresponding to the four shooting positions or ejection holes 22A–22B. The defender 60 is configured as a vertical plate 62 extending upwardly through a curved slot 63 formed in the playfield 16 which has the same general curvature as the arc 24 of the ejection holes 22A–22D. A blocking piece 64 extends horizontally outwardly from the plate 62 and is configured to overlie the ejection holes 22A–22D. Thus, when the defender 60 is in front of a particular ejection hole 22A–22D, the blocking piece 64 obstructs the shooting path of travel to prevent the game ball from reaching the guide rails 42 and basket 26. Preferably, the defender 60 is in the shape of a person with raised arms to simulate a basketball player playing defense.

A moving mechanism 66 is also mounted underneath the playfield 16 for moving the defender 60 between the various blocking positions. Preferably, the moving mechanism includes a motor 68 and a pivot arm 70 having a terminal end 72 to which the defender 60 is mounted. A microswitch (not shown) is also mounted in each ejection hole 22A–22D to determine when the game ball has reached the associated ejection hole. Thus, when the microswitch detects that the game ball has been passed from one of the ejection holes 22A–22D to another ejection hole, the microprocessor causes the motor 68 to actuate the pivot arm 70 in the appropriate direction to move the defender 60 to a blocking position in front of that ejection hole. To continually monitor the position of the defender 60 and also to stop the defender 60 in the appropriate blocking position, four U-shaped optical sensors 74 are mounted to the underside 52 of the playfield 16. The sensors 74 are well known in the art and are typically mounted on printed circuit boards. In the embodiment shown, each sensor 74 is in alignment with the pivot axis of the pivot arm 70 and one of the ejection holes 22A–22D. The sensors 74 are spaced the same radial distance from the pivot axis and are positioned so that an interrupter element 76 on the pivot arm 70 passes through the U-shaped sensors 74 as the pivot arm moves the defender between the various blocking positions. Preferably, the interrupter element 76 extends upwardly from the pivot arm 70 so that when the defender 60 is moved to a blocking position in front of an ejection hole, an optical path between the legs of the associated sensor 74 is interrupted, thereby sending a signal to the microprocessor which causes the motor 68 to stop actuating the pivot arm 70.

It is therefore an objective of the player to pass the game ball to a desired shooting location and shoot the ball before the defender arrives to block the shot. If the shot is blocked, or if a "24-second clock" indicated at 78 expires before a shot is taken, a system is provided for removing the game ball from the interactive play area 20. Preferably, a magnet 80 is mounted on the playfield 16 and positioned generally in the passing path of travel between the two middle shooting positions 22B and 22C. The magnet 80 is energized by the microprocessor in response to a blocked shot or in response to the expiration of the 24-second clock to thereby intercept the game ball in the passing lane between the two middle shooting positions 22B and 22C. Once the magnet 80 catches the game ball, the magnet 80 is de-energized to allow the game ball to roll out of the interactive area of play 20. If the game ball is blocked from one of the middle shooting positions 22B or 22C, the player loses control of all the ball poppers 50 and 58 and the associated passing ball popper 58 automatically passes the game ball to the other middle shooting position so that the magnet 80 can intercept the pass. If the game ball is blocked from one of the end shooting positions 22A or 22C, the associated passing ball popper 58 passes the game ball to the adjacent middle shooting position 22B or 22C, whereupon the associated passing ball popper 58 passes the ball to the other middle shooting position again permitting interception by the magnet 80.

Figure 3:
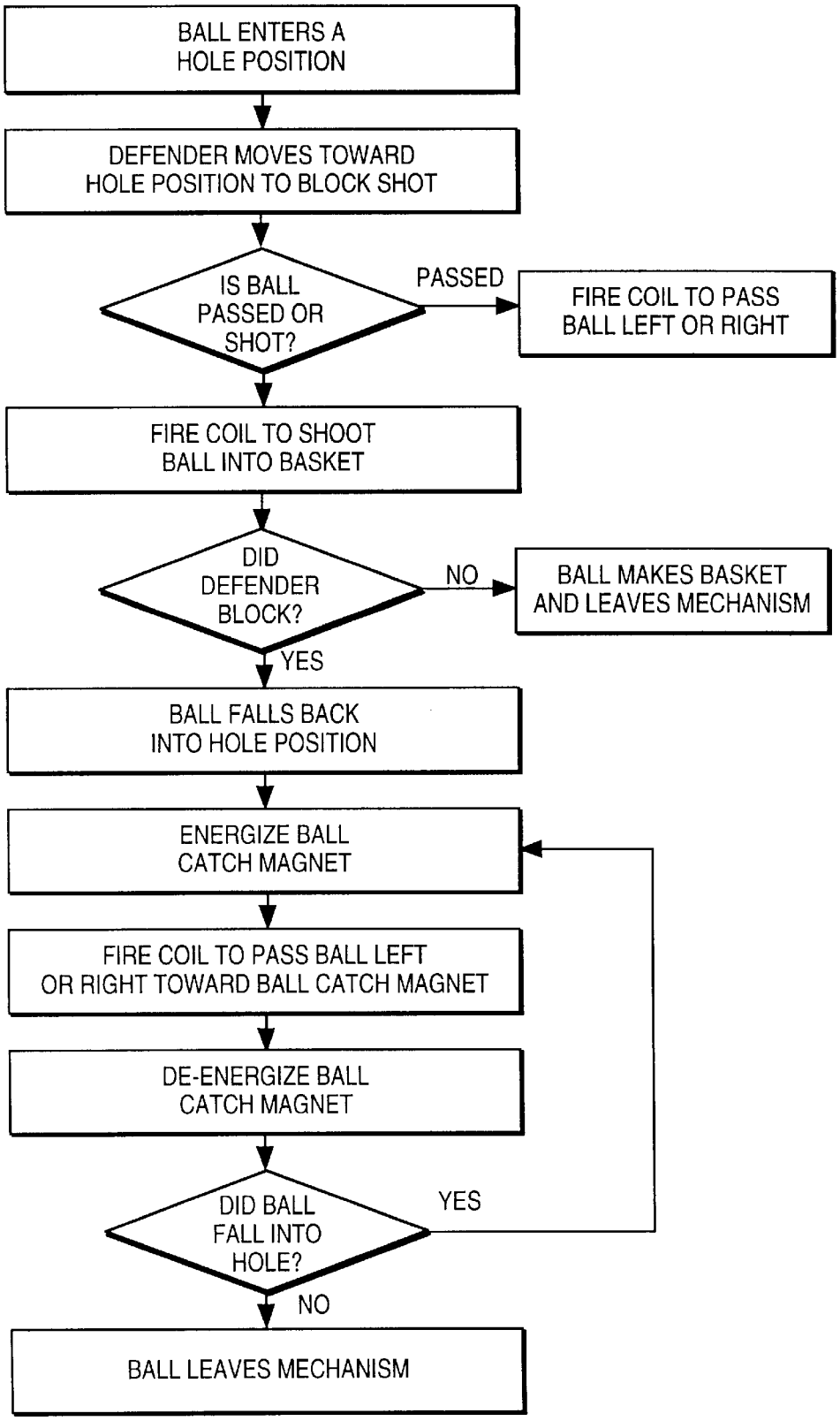
FIG. 3 is a software flow diagram indicating the operational steps of the interactive play feature.

The operation of the present invention will be described with specific reference to FIGS. 1–2, and also in accordance with the flow diagram shown in FIG. 3. During the course of a game the player will be able to shoot or otherwise direct the game ball in play onto the interactive play area 20. When the game ball falls into one of the ejection holes 22A–22D, the microswitch in that hole sends a signal to the microprocessor to cause the defender 60 to move toward an associated blocking position in front of that hole. The player then has the option to either pass the game ball to an adjacent ejection hole or shoot the ball toward the basket 26. If the player actuates the shooting ball popper 50 before the defender 60 reaches the appropriate blocking position, the game ball will be propelled through the guide rail 42 and into the basket 26. When the ball passes the optical path of the optical sensors 34, 36, a signal is sent to the microprocessor to award the player with a number of points depending on the rules of the game. If the sensors 34, 36 fail to detect the game ball, the ball will hit the microswitch 38 to thereby send a signal that the player has scored. Preferably, the defender 60 is simultaneously moved to a position directly in front of the microswitch 38 to momentarily hold the game ball in the interactive play area 20 and allow various scoring lights and sounds to indicate a successful score to the player. Once the lights and sounds are completed, the defender 60 is pivoted out of the way so that the game ball rolls out of the interactive play area 20 and on to the main field of play.

If the player shoots the game ball while the defender 60 is in the appropriate blocking position, the game ball will be blocked by the horizontally extending blocking piece 64 and the ball will fall back into that ejection hole. The associated passing ball popper 58 is then automatically actuated to pass the ball to one of the middle ejection holes 22B or 22C. The passing ball popper of the middle ejection hole is then automatically actuated to pass the ball to the other middle ejection hole. At the same time, the magnet 80 is energized to intercept the game ball in the passing lane between the two middle shooting positions 22B and 22C. Once the magnet 80 catches the game ball, the magnet 80 is de-energized to allow the game ball to roll out of the interactive area of play 20.

If the player continues to pass the game ball between the ejection holes 22A–22D for an extended time period before taking a shot, the player loses control of the ball poppers 50 and 58. Thus, upon expiration of the 24-second clock 78, the passing ball poppers 58 automatically pass the ball between the two middle ejection holes 22B and 22C and the magnet 80 is energized to intercept the game ball and let it roll off of the interactive play area 20.

Thus, an interactive play feature including pass, shoot and defend aspects for playing the game of basketball is provided to make it more challenging for a player score points.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A pinball game having an inclined playfield for supporting at least one game ball thereon, comprising:

a shooting position on the playfield;

a target spaced apart from said shooting position;

a ball popper responsive to input from a player for propelling the game ball from the shooting position toward the target, wherein said game ball normally follows a path of travel from the shooting position to the target when propelled by the shooting mechanism; and a blocking member movable to a blocking position in response to the game ball reaching a desired position, wherein said blocking member obstructs the path of travel of the game ball to prevent the game ball from reaching the target.

2. The pinball game of claim 1 further comprising a second shooting position on the playfield spaced from said shooting position and the target, and a second shooting mechanism responsive to input from a player for propelling the game ball from the second shooting position toward the target, wherein the game ball normally follows a second path of travel from said second shooting position to the target when propelled by the second shooting mechanism, the blocking member adapted to move between said blocking position and a second blocking position wherein the blocking member obstructs the second path of travel to prevent the game ball from reaching the target from the second position.

3. The pinball game of claim 1 wherein the target is a receptacle having an open top elevated above the playfield to act as a basket for receiving the game ball.

4. The pinball game of claim 3 further comprising a guide rail positioned along said path of travel to guide the game ball between the shooting position and the target.

5. The pinball game of claim 4 wherein the guide rail comprises a curved wire structure extending upwardly from the shooting position and curving toward the open top of the receptacle.

6. The pinball game of claim 1 wherein the shooting position comprises a hole formed in the playfield to retain the game ball in a fixed position with respect to the shooting mechanism.

7. The pinball game of claim 6 wherein the shooting mechanism comprises a ball popper mounted underneath the playfield and positioned to eject the game ball upwardly in a direction generally normal to the playfield.

8. The pinball game of claim 1 further comprising a moving mechanism positioned underneath the playfield for moving the blocking member to the blocking position.

9. The pinball game of claim 1 wherein said desired position comprises the shooting position, and further comprising a sensor adapted to detect when the game ball is in the shooting position, whereupon the blocking member is actuated to move into said blocking position.

10. The pinball game of claim 1 further comprising an ejecting mechanism responsive to a blocked shot for propelling the ball in a direction which results in the ball being removed from the interactive play feature field of play.

11. The pinball game of claim 10 wherein the ejecting mechanism is responsive to the expiration of a predetermined time limit for actuating the shooting mechanism.

12. A pinball game comprising:

an inclined playfield for supporting at least one game ball thereon;

a first shooting position on the playfield;

a second shooting position on the playfield spaced from said first shooting position;

a target spaced apart from said first and second shooting positions;

first and second shooting mechanisms responsive to input from a player for propelling the game ball from the respective first and second shooting positions toward the target, wherein the game ball normally follows a first shooting path of travel from said first shooting position to said target when propelled by the first shooting mechanism, and the game ball normally follows a second shooting path of travel from said second shooting position to said target when propelled by the second shooting mechanism;

first and second passing mechanisms responsive to input from a player for propelling the game ball between the respective first and second shooting positions, wherein said game ball normally follows a passing path of travel between said first and second shooting positions when propelled by either one of the first and second passing mechanisms;

a blocking member adapted to move between a first blocking position wherein a horizontally extending portion of said blocking member obstructs the first shooting path of travel to prevent said game ball from reaching the target from the first shooting position, and a second blocking position wherein said blocking member obstructs the second shooting path of travel to prevent said game ball from reaching the target from the second shooting position.

13. The pinball game of claim 12 wherein the target is a receptacle having an open top elevated above the playfield to act as a basket for receiving said game ball.

14. The pinball game of claim 13 further comprising first and second guide rails positioned along the respective first and second paths of travel to guide the game ball between the respective first and second shooting positions and the target.

15. The pinball game of claim 14 wherein the first and second guide rails each comprise a curved wire structure extending upwardly from the respective first and second shooting positions and curving toward the open top of the receptacle.

16. The pinball game of claim 12 wherein the first and second shooting positions each comprise a hole formed in said playfield to retain the game ball in a desired fixed position with respect to the first and second shooting mechanisms and the first and second passing mechanisms.

17. The pinball game of claim 16 wherein the first and second shooting mechanisms each comprise a ball popper mounted underneath the playfield and positioned to eject the game ball upwardly in a direction generally normal to the playfield, and wherein the first and second passing mechanisms each comprise a ball popper mounted adjacent the corresponding first and second shooting mechanisms at an angle such that the game ball is ejected upwardly at an angle toward the other shooting position.

18. The pinball game of claim 17 further comprising a moving mechanism positioned underneath the playfield for moving the blocking min the blocking member extends upwardly from an end of the pivot arm and through a curved slot formed in the playfield, a portion of said blocking member extending generally horizontally so that when the pivot arm moves the blocking member to one of the first and second blocking positions, said portion obstructs the corresponding shooting path of travel to block the shot of a player.

19. The pinball game of claim 12 further comprising a sensor adapted to detect when the game ball has reached one of the first and second shooting positions, whereupon the blocking member is actuated to move into the corresponding blocking position.

20. The pinball game of claim 12 further comprising a magnet mounted on the playfield and positioned generally in the passing path of travel, said magnet adapted to be energized in response to a blocked shot to thereby intercept the game ball in the passing path of travel, whereupon the magnet is deenergized to allow the game ball to roll out of the field of play of the interactive play feature.

21. The pinball game of claim 20 wherein the magnet is responsive to the expiration of a predetermined time limit for intercepting the game ball in the passing path of travel.

22. A pinball game comprising:

an inclined playfield for supporting at least one game ball thereon;

a first ejection hole formed in the playfield to retain the game ball in a fixed first shooting position;

a second ejection hole formed in the playfield to retain the game ball in a fixed second shooting position spaced from said first shooting position;

a receptacle positioned above the playfield and horizontally spaced from said first and second ejection holes, said receptacle having an open top elevated above the playfield to act as a basket for receiving the game ball;

a first curved guide rail extending upwardly from the first ejection hole and curving toward the receptacle to define a first shooting path of travel and guide the game ball from the first shooting position to the receptacle;

a second curved guide rail extending upwardly from the second ejection hole and curving toward the receptacle to define a second shooting path of travel and guide the game ball from the second shooting position to the receptacle;

first and second shooting mechanisms responsive to input from a player for propelling the game ball generally upwardly from the respective first and second shooting positions toward the receptacle, wherein the game ball normally follows the first shooting path of travel from the first shooting position to the receptacle when propelled by the first shooting mechanism, and the game ball normally follows the second shooting path of travel from the second shooting position to the receptacle when propelled by the second shooting mechanism;

first and second passing mechanisms responsive to input from a player for propelling the game ball between the respective first and second shooting positions, wherein the game ball normally follows a passing path of travel between said first and second shooting positions when propelled by either one of the first and second passing mechanisms;

a blocking member adapted to move between a first blocking position wherein a horizontally extending portion of said blocking member obstructs the first shooting path of travel to prevent the game ball from reaching the receptacle from the first shooting position, and a second blocking position wherein said horizontally extending portion of the blocking member obstructs the second shooting path of travel to prevent the game ball from reaching the receptacle from the second shooting position;

a moving mechanism positioned underneath the playfield for moving the blocking member between the first and second blocking positions, said moving mechanism including a motor having a pivot arm, wherein the blocking member extends upwardly from an end of the pivoame ball has reached one of the first and second shooting positions, whereupon the blocking member is actuated to move into the corresponding blocking position; and a magnet mounted on the playfield and positioned generally in the passing path of travel, said magnet adapted to be energized in response to a blocked shot and in response to the expiration of a predetermined time limit to thereby intercept the game ball in the passing path of travel, whereupon the magnet is de-energized to allow the game ball to roll out of the field of play of the interactive play feature.

23. A pinball game comprising:

an inclined playfield for supporting at least one game ball thereon;

first, second and third shooting positions on the playfield;

a target spaced apart from said first, second and third shooting positions;

first, second and third shooting mechanisms responsive to input from a player for propelling the game ball from the respective first, second and third shooting positions toward the target, wherein said game ball normally follows a first shooting path of travel from said first shooting position to said target when propelled by the first shooting mechanism, a second shooting path of travel from said second shooting position to said target when propelled by the second shooting mechanism, and a third shooting path of travel from said third shooting position to said target when propelled by the third shooting mechanism;

a first passing mechanism responsive to input from a player for propelling the game ball between the first and second shooting positions, wherein said game ball normally follows a first passing path of travel between said first and second shooting positions when propelled by the first passing mechanism;

a second passing mechanism responsive to input from a player for propelling the game ball between the second and first shooting positions, wherein said game ball normally follows said first passing path of travel between said second and first shooting positions when propelled by the second passing mechanism;

a third passing mechanism responsive to input from a player for propelling the game ball between the second and third shooting positions, wherein the game ball normally follows a second passing path of travel between said second and third shooting positions when propelled by passing mechanism;

a fourth passing mechanism responsive to input from a player for propelling the game ball between the third and second shooting positions, wherein said game ball normally follows said second passing path of travel between said third and second shooting positions when propelled by the fourth passing mechanism;

a blocking member adapted to move between a first blocking position wherein said blocking member obstructs the first shooting path of travel to prevent said same ball from reaching the target from the first shooting position, a second blocking position wherein said blocking member obstructs the second shooting path of travel to prevent said game ball from reaching the target from the second shooting position, and a third blocking position wherein said blocking member obstructs the third shooting path of travel to prevent said game ball from reaching the target from the third shooting position; and a sensor adapted to detect when the game ball is approaching one of the first, second and third shooting positions, whereupon the blocking member is actuated to move into the corresponding blocking position;

whereby a player has an option of shooting the game ball or passing to the second shooting position when the game ball is in the first shooting position, an option of shooting the game ball or passing to either the first or second shooting positions when the game ball is in the second shooting position, and an option of shooting the game ball or passing to the second shooting position when the game ball is in the third shooting position.

24. The pinball game of claim 23 further comprising a moving mechanism positioned underneath the playfield for moving the blocking member between the first, second and third blocking positions, said moving mechanism including a motor having a pivot arm, wherein said blocking member extends upwardly from an end of the pivot arm and through a curved slot formed in the playfield, a portion of said blocking member extending generally horizontally so that when the pivot arm moves the blocking member to one of the first, second and third blocking positions, said portion obstructs the corresponding shooting path of travel to block the shot of a player.

25. The pinball game of claim 23 further comprising a magnet mounted on the playfield and positioned generally in the first passing path of travel;

wherein the first passing mechanism is adapted to automatically pass the game ball to the second shooting position in response to a blocked shot from the first shooting position, during which pass said magnet is energized to intercept the game ball, whereupon the magnet is de-energized to allow the game ball to roll out of the field of play of the interactive play feature; and, wherein the second passing mechanism is adapted to automatically pass the game ball to the first position in response to a blocked shot from the second shooting position, during which pass said magnet is energized to intercept the game ball, whereupon the magnet is de-energized to allow the game ball to roll out of the field of play of the interactive play feature.

26. The pinball game of claim 25 wherein the third passing mechanism is adapted to automatically pass the game ball to the second shooting position in response to a blocked shot from the third shooting position, and the second passing mechanism is adapted to automatically pass the game ball toward the first shooting position, wherein said magnet is energized to intercept the game ball in the first passing path of travel.

27. The pinball game of claim 25 wherein the magnet is responsive to the expiration of a predetermined time limit for intercepting the game ball in the first passing path of travel.

* * * * *